US007044265B2

(12) United States Patent
Murphy

(10) Patent No.: US 7,044,265 B2
(45) Date of Patent: May 16, 2006

(54) CONSTANT DIRECTIVITY ACOUSTIC HORN

(75) Inventor: David John Murphy, Henley Beach (AU)

(73) Assignee: Krix Loudspeakers Pty Ltd., South Australia (AU)

( * ) Notice: Subject to any disclaimer, the term of this patent is extended or adjusted under 35 U.S.C. 154(b) by 283 days.

(21) Appl. No.: 10/663,563

(22) Filed: Sep. 16, 2003

(65) Prior Publication Data

US 2004/0060768 A1 Apr. 1, 2004

(30) Foreign Application Priority Data

Sep. 17, 2002 (AU) ..... 2002951421

(51) Int. Cl.
*G10K 11/02* (2006.01)
*H04R 1/20* (2006.01)

(52) U.S. Cl. ..... 181/192; 181/185; 381/339; 381/340

(58) Field of Classification Search ..... 181/192, 181/185; 381/339, 340
See application file for complete search history.

(56) References Cited

U.S. PATENT DOCUMENTS

| | | | | | |
|---|---|---|---|---|---|
| 2,537,141 | A | | 1/1951 | Klipsch | |
| 4,071,112 | A | | 1/1978 | Keele, Jr. | |
| 4,171,734 | A | * | 10/1979 | Peveto et al. | 181/192 |
| 4,187,926 | A | | 2/1980 | Henricksen et al. | |
| 4,308,932 | A | | 1/1982 | Keele, Jr. | |
| 4,469,921 | A | * | 9/1984 | Kinoshita | 381/340 |
| 4,685,532 | A | * | 8/1987 | Gunness | 181/185 |
| 4,975,965 | A | * | 12/1990 | Adamson | 381/343 |
| 5,004,067 | A | * | 4/1991 | Patronis | 181/188 |
| 5,020,630 | A | * | 6/1991 | Gunness | 181/192 |
| 5,285,025 | A | * | 2/1994 | Yoshioka | 181/192 |
| 5,750,943 | A | * | 5/1998 | Heinz | 181/152 |
| 5,925,856 | A | * | 7/1999 | Meyer et al. | 181/152 |
| 5,991,421 | A | * | 11/1999 | Faraone | 381/338 |
| 6,059,069 | A | * | 5/2000 | Hughes, II | 181/152 |
| 6,466,680 | B1 | * | 10/2002 | Gelow et al. | 381/340 |

FOREIGN PATENT DOCUMENTS

| | | | |
|---|---|---|---|
| DE | 10230409 C1 | * | 10/2003 |
| JP | 06133385 A | * | 5/1994 |
| JP | 09205695 A | * | 8/1997 |
| JP | 10041737 A | * | 2/1998 |

* cited by examiner

*Primary Examiner*—Edgardo San Martin
(74) *Attorney, Agent, or Firm*—Klauber & Jackson

(57) ABSTRACT

An improved throat (2) for transmitting acoustic energy from a source driver unit (7) to a feeder section (3) of a directivity controlling acoustic horn is disclosed. The throat (2) comprises: a circular throat entrance (2*i*) connectable to the source driver unit (7); a rectangular throat exit (2*e*) connectable to or integral with the feeder section (3); and a circular cross-section to rectangular cross-section transition portion (2*a*) extending between the throat entrance (2*i*) and the throat exit (2*e*). The throat (2) is shaped such that its profiles initially diverge from an axis longitudinal to the throat (14) at the same angle in a direction from the throat entrance (2*i*) towards the throat exit (2*e*). Such a throat, when fitted in an appropriate acoustic horn with a source driver unit having a taper matching the aforesaid profile angles, provides a smooth transition for sound waves propagating out from the source driver unit into the horn.

10 Claims, 6 Drawing Sheets

CONSTANT DIRECTIVITY ACOUSTIC HORN

FIELD OF THE INVENTION

The field of the invention relates to acoustic horns, and more particularly to acoustic horns providing substantially uniform polar frequency-response plots in both the horizontal and vertical directions.

BACKGROUND TO THE INVENTION

An acoustic horn is a structure which utilises outwardly flaring rigid walls to provide an expanding passage for acoustic energy between a throat entrance and a mouth exit. The acoustic horn is stimulated by a source driver unit which produces acoustic energy, and the acoustic horn then modifies and controls the acoustic energy.

The audio industry has spent many decades on the design of acoustic horns with defined areas of coverage. For instance, 90° in a horizontal plane by 40° in a vertical plane, or 60° by 40°, and so on. Generically they are called constant directivity horns.

A constant directivity acoustic horn generally comprises a throat entrance and a mouth exit joined by continuous rigid walls. A throat section extends away from the throat entrance and then extends to a feeder section which is rectangular in transverse cross-sectional shape. Acoustical energy is coupled thereto from a source driver unit connected to the throat entrance. The feeder section has an expanding transverse area formed by a first pair of walls which diverge outwardly from each other, and a second pair of walls which are substantially parallel and joined to the first pair.

The mouth exit of the horn has a rectangular configuration and is formed by a bell section having walls which diverge outwardly from the end of the feeder section, there being a first pair of diverging walls, and a second pair of diverging walls which join with the first pair of walls of the bell section along the edges to form an integral unit. The walls of the bell section may be flared outwardly an additional amount at a transverse plane immediately adjacent to the mouth to provide improved control of the radiation of acoustic energy.

In general the divergence angle between the first pair of walls and between the second pair of walls of the bell section determines the dispersion angle of the acoustical energy. A feature of this geometry is that the side profile view and top profile view angles and the dimensions of the mouth can be varied independently in order to obtain specified outcomes.

Many shapes of constant directivity horns have been evolved over the years to try to achieve a more uniform coverage. Initial attempts were by Olsen with multi-cellular horns, Klipsch (U.S. Pat. No. 2,537,141) with radial sectorial, Keele (U.S. Pat. No. 4,071,112) with the concept of outer flanges, Henricksen et al (U.S. Pat. No. 4,187,926) with a design "in reverse" (Manta Ray), Keele again (U.S. Pat. No. 4,308,932) with profiles specified by a formula, Gunness (U.S. Pat. No. 4,685,532) with throat vanes (pseudo horns). Most of these shapes (e.g. the Manta Ray) which have evolved to meet the need for uniform coverage (directivity control) have other disadvantages, for example, an irregular on-axis frequency response.

It is an object of the present invention to provide an improved constant directivity horn and/or horn component.

It is a further object of the present invention to provide a horn and/or horn component that provides improved directivity control in the high frequency ranges.

SUMMARY OF INVENTION

According to the invention there is provided a throat for transmitting acoustic energy from a source driver unit to a feeder section of a directivity controlling acoustic horn, the throat comprising:

circular throat entrance connectable to the source driver unit, the throat entrance having a diameter;

a rectangular throat exit connectable to or integral with the feeder section, the throat exit defined by a pair of parallel long sides and a pair of parallel short sides, the short sides having a length less than or equal to the diameter of the throat entrance; and circular cross-section to rectangular cross-section transition portion extending between the throat entrance and the throat exit, the transition portion having an internal surface, wherein a pair of opposite profiles of the internal surface of the throat, lying within a first plane that bisects the throat entrance and perpendicularly bisects the long side of the throat exit, initially diverge in a direction from the throat entrance towards the throat exit.

Preferably each said profile initially diverges at substantially the same angle with respect to an axis longitudinal to the throat.

Preferably said profiles of the throat converge to a neck having a width less that the diameter of the entrance to the throat, thereby improving the dispersion of high frequency acoustic energy.

Preferably the throat is shaped such that its profiles, through substantially all cross-sections longitudinal to the throat, initially diverge from the longitudinal axis of the throat in a direction from the throat entrance towards the throat exit.

Preferably all of the initial angles of divergence match.

According to a second aspect of the invention there is provided a throat for transmitting acoustic energy from a source driver unit to a feeder section of a directivity controlling acoustic horn, the throat comprising:

a circular throat entrance connectable to the source driver unit, the throat entrance having a diameter;

a rectangular throat exit connectable to or integral with the feeder section, the throat exit defined by a pair of parallel long sides and a pair of parallel short sides; and a circular cross-section to rectangular cross-section transition portion extending between the throat entrance and the throat exit, the transition portion having an internal surface, wherein the throat is shaped such that its profiles, through substantially all cross-sections longitudinal to the throat, initially diverge from an axis longitudinal to the throat at the same angle in a direction from the throat entrance towards the throat exit.

According to a third aspect of the invention there is provided a directivity controlling acoustic horn assembly comprising:

a source driver unit having a divergent frusto-conical portion terminating in a circular exit for transmission of acoustic energy;

a throat having: a circular entrance; a rectangular exit; and a circular cross-section to rectangular cross-section transition portion extending between the throat entrance and the throat exit, the circular entrance matching the circular exit of the source driver and the rectangular exit having a height and a width;

a feeder section having a first end and a second end, the first end connected to the exit of the throat; and a bell section having an entrance and terminating in an open mouth, the entrance of the bell section connected to or integral with the second end of the feeder section, wherein opposite profiles of the throat, lying within a first plane that bisects the throat entrance and perpendicularly bisects the long side of the throat exit, substantially match the angle of the frusto-conical portion at the exit to the source driver unit thereby providing a smooth transition for sound waves propagating from the source driver unit into the throat.

Preferably the height of the rectangular throat exit is less than the diameter of the throat entrance.

Preferably said profiles of the throat converge to a neck having a height less that the diameter of the entrance to the throat, thereby improving the dispersion of high frequency acoustic energy.

Preferably the throat is shaped such that its profiles, through substantially all cross-sections longitudinal to the throat, substantially match the angle of the frusto-conical portion at the exit to the source driver unit thereby providing a smooth transition for sound waves propagating from the source driver unit into the throat.

Specific embodiments of the invention will now be described in some further detail with reference to and as illustrated in the accompanying figures. These embodiments are illustrative, and are not meant to be restrictive of the scope of the invention.

DETAILED DESCRIPTION OF THE PREFERRED EMBODIMENTS

Figure 1:
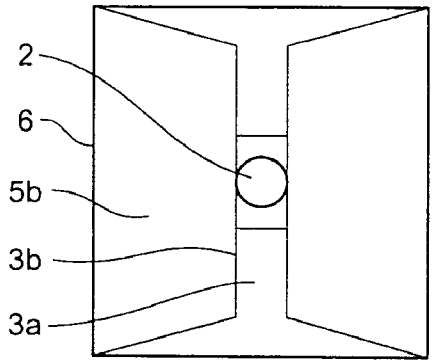
FIG. 1 is a front view of a generic constant directivity acoustic horn.
Figure 2A:
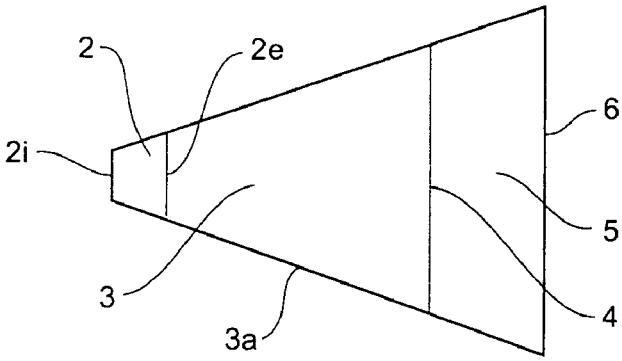
FIG. 2*a* is a vertical profile cross-sectional view of the acoustic horn in FIG. 1.
Figure 2B:
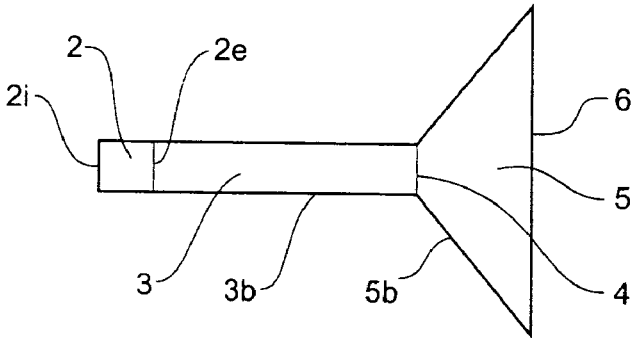
FIG. 2*b* is a horizontal profile cross-sectional view of the acoustic horn of FIG. 1.

Referring to FIGS. 1, 2*a* and 2*b*, a generic prior art constant directivity acoustic horn is shown. The acoustic horn comprises a throat 2 having a circular entrance 2*i* and a rectangular exit 2*e*, a feeder section 3 having an expanding rectangular cross-section ending at a plane indicated by the line 4 and a bell section 5 that terminates in a open mouth 6. The divergent profile of the first pair of walls 3*a*, which is determined by the specified beam angle is clearly shown in FIG. 2*a*. The second pair of walls 5*b* of the bell section 5 are shown in FIG. 2*b*.

In FIG. 1 front view, the throat 2, the mouth 6, and the location of the feeder section wall 3*b* is shown.

Figure 3:
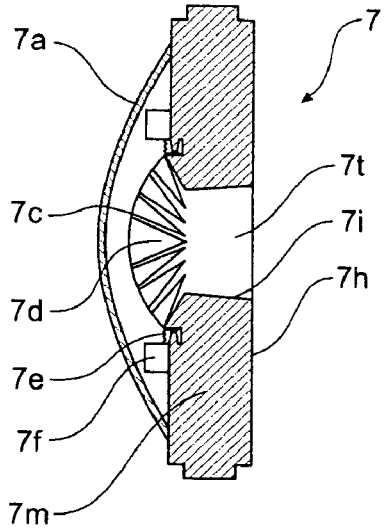
FIG. 3 is a cross-sectional view of a typical source driver unit (a "compression driver").
Figure 4A:
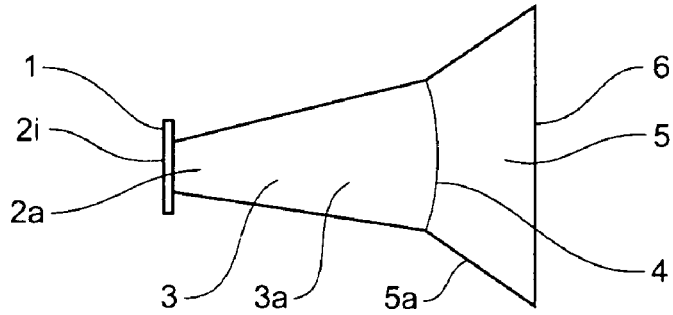
FIG. 4*a* is a vertical profile cross-sectional view of a constant directivity "angular" acoustic horn.
Figure 4B:
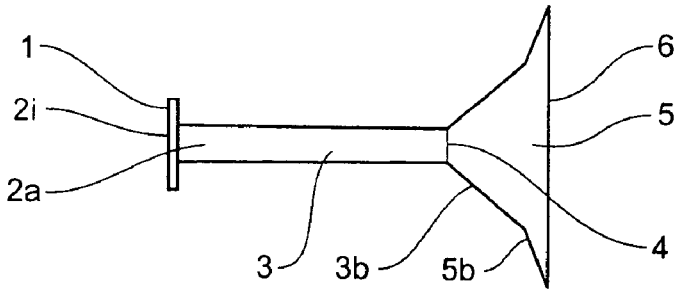
FIG. 4*b* is a horizontal profile cross-sectional view of the "angular horn" of FIG. 4*a*.
Figure 5A:
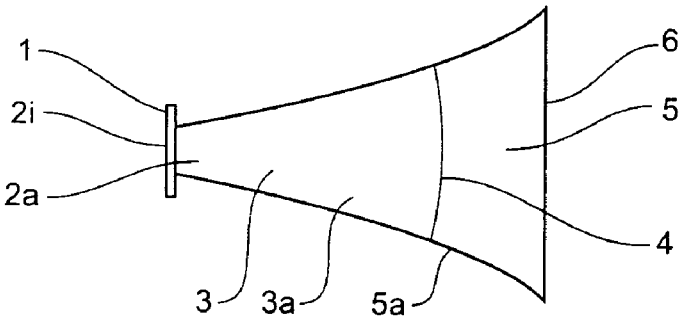
FIG. 5*a* is a vertical profile cross-sectional view of a constant directivity "curvy" acoustic horn.
Figure 5B:
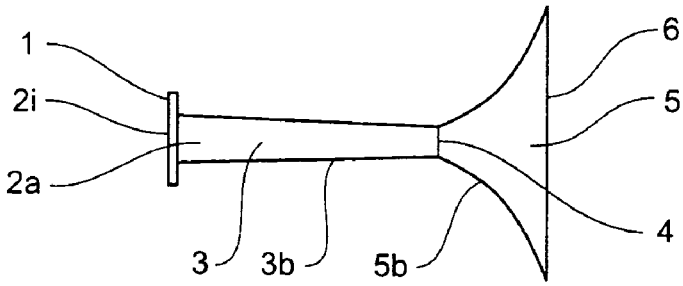
FIG. 5*b* is a horizontal profile cross-sectional view of the "curvy" acoustic horn of FIG. 5*a*.

A typical source driver unit 7 is shown as FIG. 3. It is known as a compression driver, and is an electromagnetic converter of electrical energy to acoustical energy. Acoustical energy is generated by movement of the diaphragm 7*c*, which is moved by a coil of wire 7*e* immersed in the magnetic field of the magnet structure 7*m*. The diaphragm assembly is mounted in a circular frame 7*f*. The acoustical energy (sound) radiated from the concave side of the diaphragm is guided by a series of concentric tapered cylinders called phase plugs 7*d* into the throat 7*t* of the unit. The driver throat 7*t* is frusto-conical in shape and has an exit angle shown as 7*i*. Acoustical energy is also radiated from the convex side of the diaphragm 7*c*, but is confined by the cover 7*a*. The surface 7*h* is the mounting surface which attaches to a flange on the horn.

Further prior art constant directivity acoustic horns are shown in FIGS. 4*a* to 5*b*. In general they have the same features referred to already. The source driver unit is attached to the flange 1, and passes acoustic energy into the throat entrance 2*i*. Note that throat entrance 2*i* is usually round in transverse shape to provide a better match to the circular shape of the source driver unit. The acoustic energy then passes through a short section of transition 2*a* from round to rectangular and through the feeder section 3 into the bell section 5. The acoustic energy is guided in the side view plane by profile 3*a* and 5*a* and in the top view plane by profiles 5*a* and 5*b*, depending on whether the acoustic horn has an "angular" or "curvy" appearance.

Figure 6:
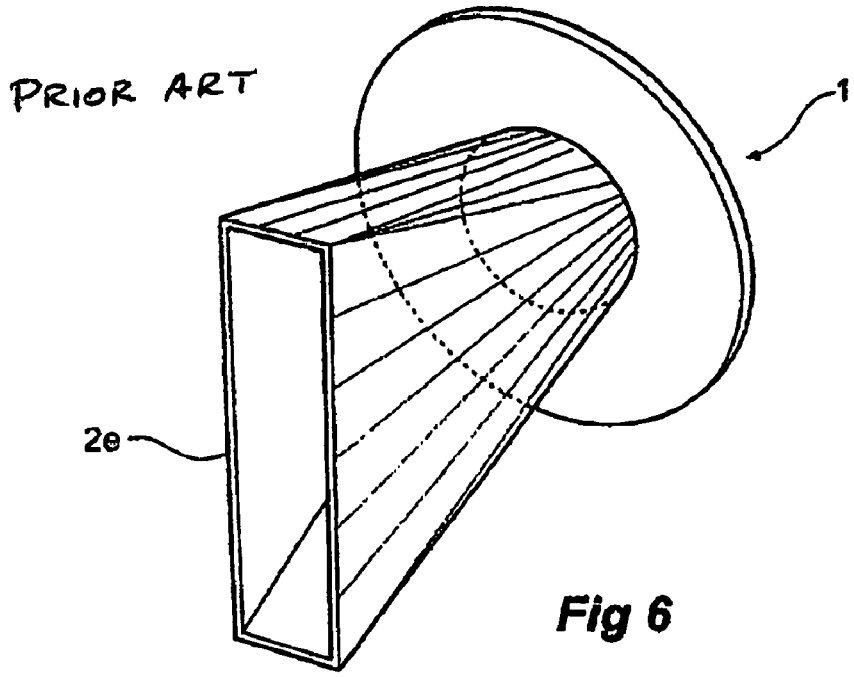
FIG. 6 is a perspective view of the throat shown in FIGS. 6*a* and 6*b*.
Figure 6A:
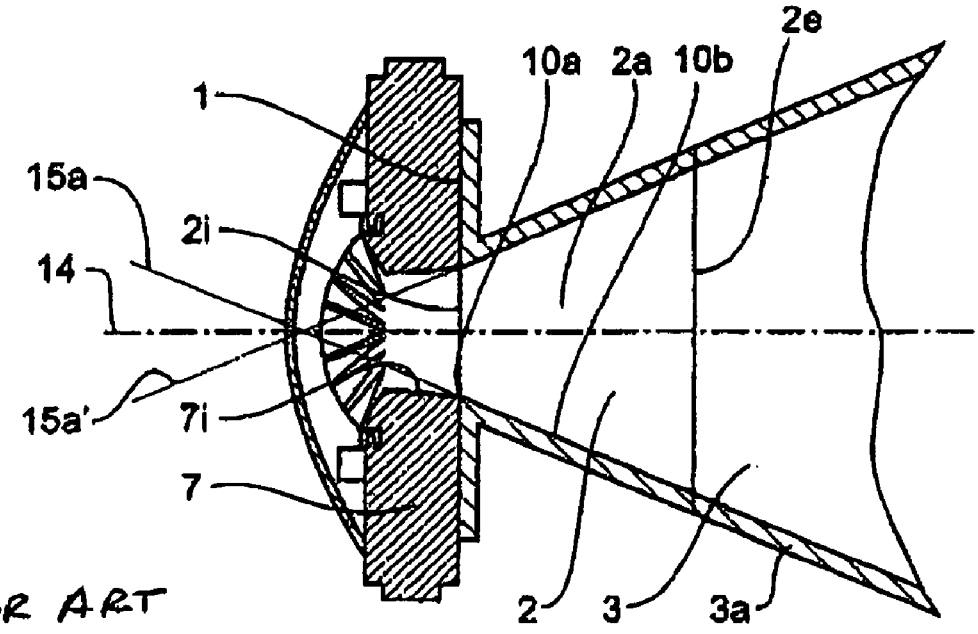
PRIOR ART Figure 6a
FIG. 6*a* is a vertical profile cross-sectional view of a throat of a constant directivity acoustic horn with the source driver unit of FIG. 4 attached.
Figure 6B:
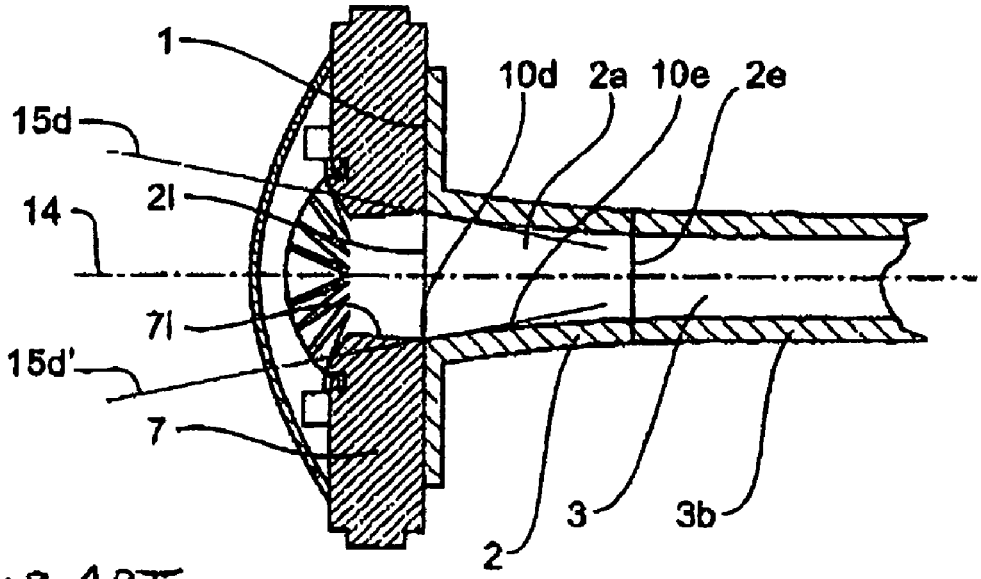
PRIOR ART Figure 6b
FIG. 6*b* is a horizontal profile cross-sectional view of the throat and source driver shown in FIG. 6*a*.

Enlarged views of the source driver 7 and throat 2 are shown in FIGS. 6*a* and 6*b*.

Referring to the vertical profile cross-sectional view of FIG. 6*a*, the source driver unit 7 is attached to the flange 1, and passes acoustic energy into the throat entrance 2*i* of the acoustic horn and through the round to rectangular transition region 2*a*. The feeder section 3 is shown, as is the profile of the first set of walls or wall portions 3*a*. The exit taper angle 7*i* on the throat of the source driver unit 7 shows a discontinuity at 10*a* compared to the profile of the first set of walls 3*a*.

Referring to the horizontal profile cross-sectional view of FIG. 6*b*, it can be seen that the exit taper angle 7*i* on the throat of the source driver unit 7 also shows a discontinuity at 10*d* compared to the profile of the second set of walls or wall portions 3*b*.

The discontinuities at 10*a* and 10*d* referred to above create disturbances in the sound waves as they pass through the throat entrance into the throat at shorter wavelengths, in particular where the wavelengths are less than the diameter of the throat entrance. In the horizontal profile, illustrated in FIG. 6*b*, the discontinuity is particularly apparent with tangent lines 15*d* and 15*d'* converging in a direction towards the throat exit 2*e*. While this convergence is convenient given that generally the diameter of the throat entrance 2*i* is greater than the length of the short sides of the rectangular throat exit 2*e*, the inventor has observed that it creates acoustic disturbances. The conveyance towards the throat exit 2*e* is also illustrated in FIG. 6.

Figure 7:
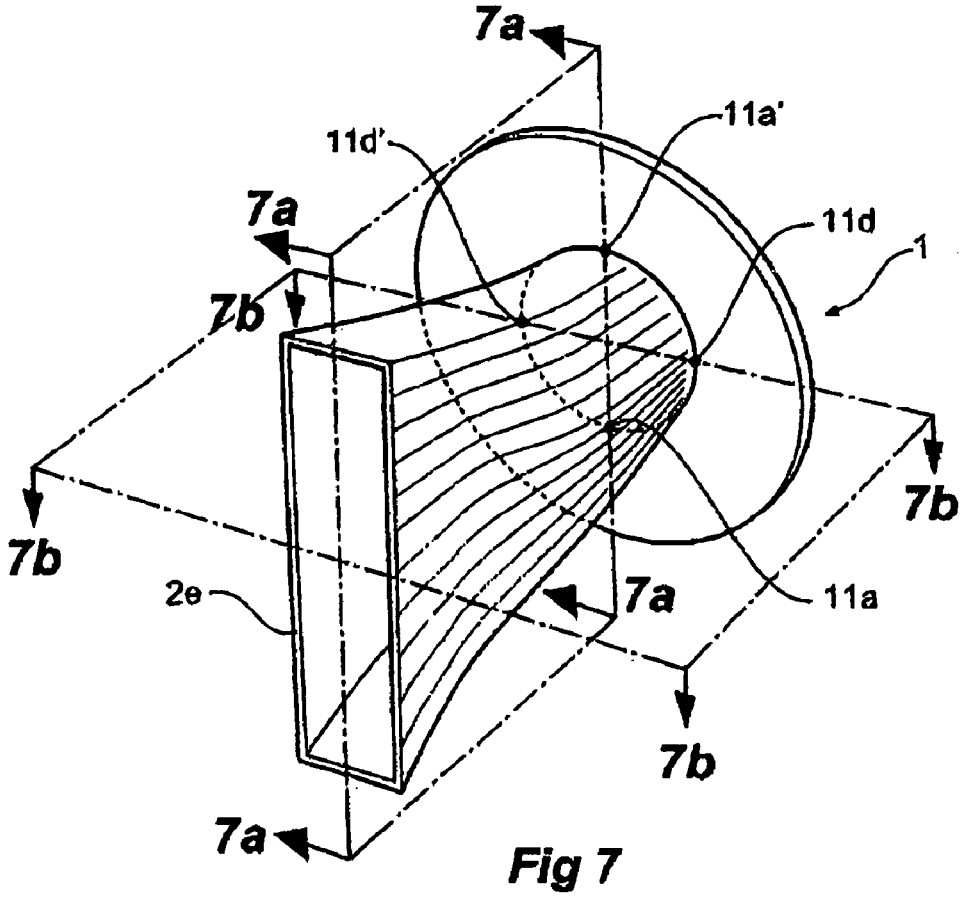
FIG. 7 is a perspective view of a throat according to a first embodiment of the invention.

Referring now to FIG. 7, a first embodiment of the invention is shown. It can be seen that a pair of opposite profiles of the internal surface of the throat 2, lying within a plane indicated in dotted outline and marked 7*b*—7*b*—7*b*—7*b*, initially diverge in a direction from the throat entrance towards the throat exit. This divergence, clearly illustrated by tangent lines 15*a* and 15*a*' in FIG. 7*b* is in marked contrast to the convergence shown by tangent lines 15*d* and 15*d*' in FIG. 6*b*.

Figure 7A:
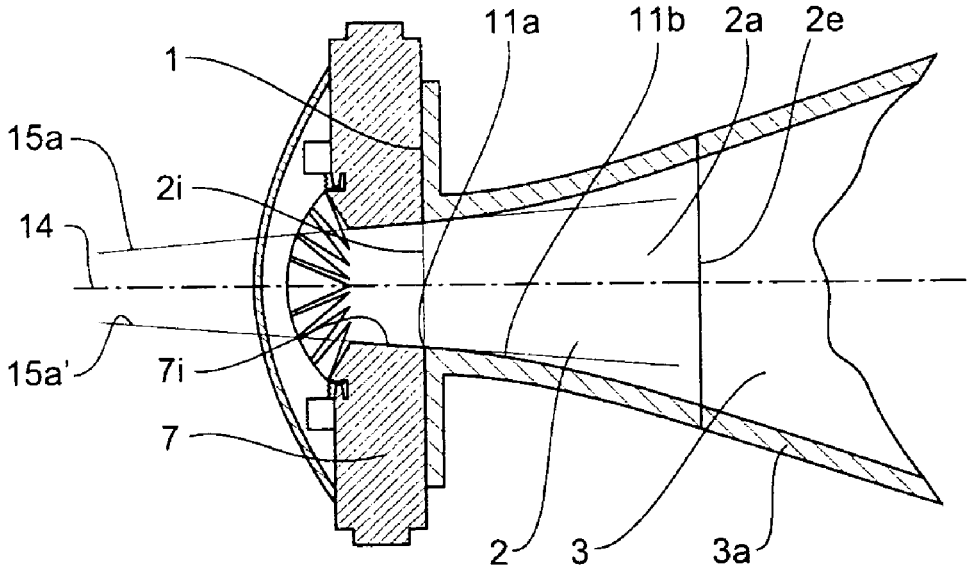
FIG. 7*a* is vertical profile cross-sectional view of the throat of FIG. 7.
Figure 7B:
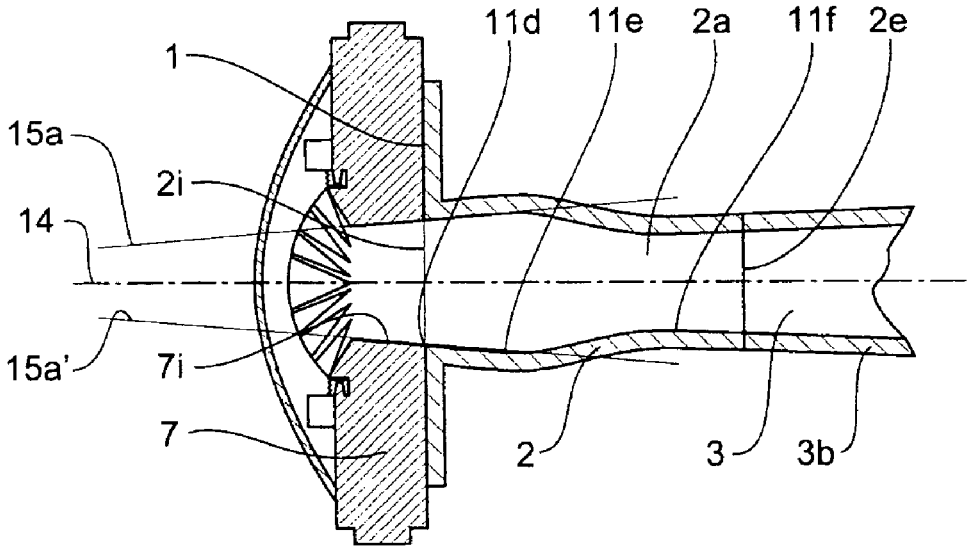
FIG. 7*b* is a horizontal profile cross-sectional view of the throat of FIGS. 7 and 7*a*.

FIGS. 7*a* and 7*b* show cross-sectional views of the first embodiment of the invention at planes 7*a*—7*a*—7*a*—7*a* and 7*b*—7*b*—7*b*—7*b* (shown in FIG. 7). Referring to the vertical profile cross-sectional view of FIG. 7*a*, the source driver unit 7 is attached to the flange 1 and passes acoustic energy into the throat entrance 2*i* and through the round to rectangular transition region 2*a* into the feeder region 3. The profile of the first pair of walls or wall portions 3*a* has an angle of commencement 11*a* which matches the exit angle 7*i* of the driver source unit. The profile smoothly changes through 11*b* to that desired for the beam angle 3*a*. The acoustic energy then passes into the feeder region 3, where the second pair of walls are substantially parallel.

Referring to the horizontal profile cross-sectional view of FIG. 7*b*, it can be seen that the profile of the second pair of walls or wall portions 3*b* also has an angle of commencement 11*d* which matches the exit angle 7*i* of the source driver unit. The profile then smoothly changes through 11*e* and 11*f* to that of 3*b*.

A feature of this change is that the appropriate transverse area is maintained while the shape of its transverse section smoothly changes from circular to elliptical to rectangular. That is, the cross-sectional area growth rate down the throat 2 towards the feeder section 3 can be made according to a desired formula. The acoustic energy then passes into the feeder region 3, where the second pair of walls is substantially parallel and the first pair of walls diverge.

FIGS. 7*a* and 7*b* show opposite profiles in vertical and horizontal profiles respectively. In this preferred embodiment of the invention, the throat is shaped such that its profiles through substantially all cross sections longitudinal to the throat (not just the vertical and horizontal cross-sections) substantially match the angle 7*i* of the frusto-cronical portion at the exit to the source driver unit 7 thereby providing a smooth transition for sound waves propagating from the source driver unit 7 into the throat 2.

Figure 8A:
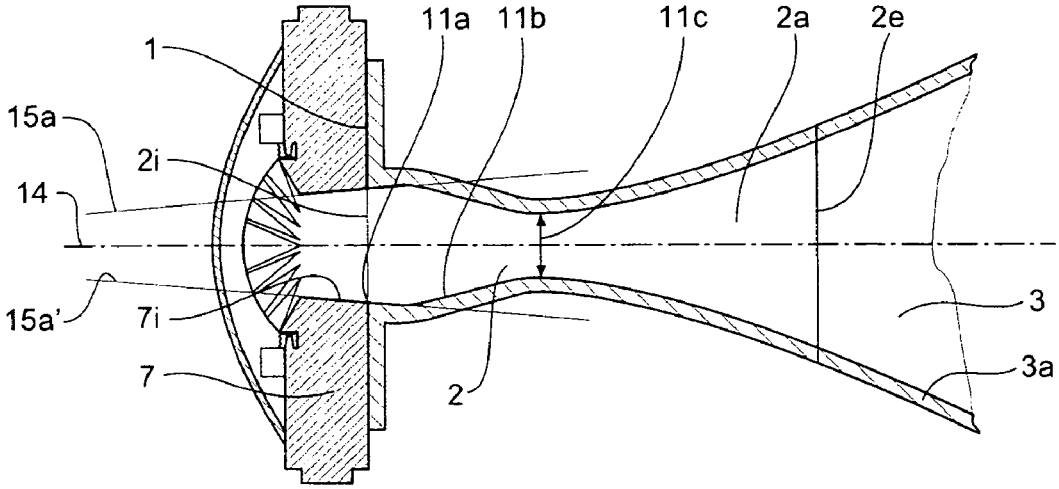
FIG. 8*a* is a vertical profile cross-sectional view of a throat according to a second embodiment of the invention.
Figure 8B:
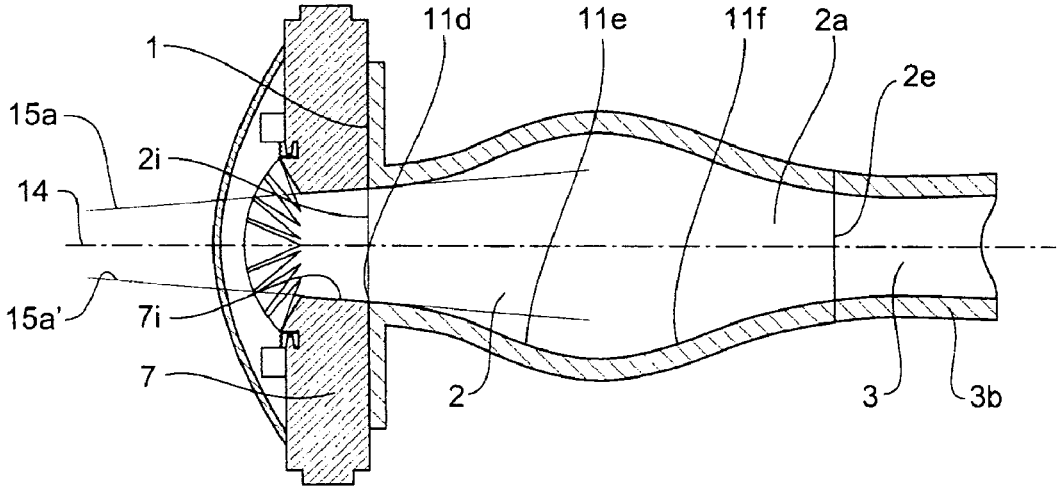
FIG. 8*b* is a horizontal profile cross-sectional view of throat of FIG. 8*a*.

A second embodiment of the invention is shown in FIGS. 8*a* and 8*b*. Referring to the vertical profile cross-sectional view of FIG. 8*a* the source driver unit 7 is again attached to the flange 1 and passes acoustic energy into the throat entrance 2*i* and through the round to rectangular transition region 2*a* into the feeder region 3. Again, the profile of the first pair of walls or wall portions 3*a* has an angle of commencement 11*a* which matches the exit angle 7*i* of the driver source unit. The profile smoothly changes through 11*b* and 11*c* to that desired 3*a* for the beam angle. The acoustic energy then passes into the feeder region 3, where the second pair of walls are substantially parallel.

With this embodiment of the invention, the profile converges/narrows to a neck having a height/width 11*c*, a length smaller than the exit size of the source driver unit 7, giving a better dispersion of high frequency acoustic energy into the acoustic horn.

Referring to the horizontal profile cross-sectional view of FIG. 8*b*, it can be seen that the profile of the second pair of walls or wall portions 3*b* also has an angle of commencement 11*d* which matches the exit angle 7*i* of the source driver unit. The profile then smoothly changes through 11*e* and 11*f* to that of 3*b*.

Again, a feature of this change is that the appropriate transverse area is maintained while the shape of its transverse section smoothly changes from circular to elliptical to rectangular. That is, the cross-sectional area growth rate down the throat 2 towards the feeder section 3 can be made according to a desired formula. The acoustic energy then passes into the feeder region 3, where the second pair of walls are substantially parallel and the first pair of walls diverge.

With the embodiments described above, directivity control is improved particularly in the high frequency ranges where wavelengths are less than the diameter of the throat entrance.

While the present invention has been described in terms of preferred embodiments in order to facilitate better understanding of the invention, it should be appreciated that various modifications can be made without departing from the principles of the invention. Therefore, the invention should be understood to include all such modifications within its scope.

The invention claimed is:

1. A throat for transmitting acoustic energy from a source driver unit to a feeder section of a directivity controlling acoustic horn, the throat comprising:

a circular throat entrance connectable to the source driver unit, the throat entrance having a diameter;

a rectangular throat exit connectable to or integral with the feeder section, the throat exit defined by a pair of parallel long sides and a pair of parallel short sides, the short sides having a length less than the diameter of the throat entrance; and a circular cross-section to rectangular cross-section transition portion extending between the throat entrance and the throat exit, the transition portion having an internal surface, wherein a pair of opposite profiles of the internal surface of the throat, lying within a first plane that bisects the throat entrance and perpendicularly bisects the long side of the throat exit, initially diverge in a direction from the throat entrance towards the throat exit.

2. A throat as claimed in claim 1 wherein each said profile initially diverges at substantially the same angle with respect to an axis longitudinal to the throat.

3. A throat as claimed in claim 2 wherein said profiles of the throat converge to a neck having a width less that the diameter of the entrance to the throat, thereby improving the dispersion of high frequency acoustic energy.

4. A throat as claimed in claim 3 wherein the throat is shaped such that its profiles, through substantially all cross-sections longitudinal to the throat, initially diverge from the longitudinal axis of the throat in a direction from the throat entrance towards the throat exit.

5. A throat as claimed in claim 3 wherein the throat is shaped such that its profiles, through substantially all cross-sections longitudinal to the throat, initially diverge from the longitudinal axis of the throat at the same angle in a direction from the throat entrance towards the throat exit.

6. A throat for transmitting acoustic energy from a source driver unit to a feeder section of a directivity controlling acoustic horn, the throat comprising:

a circular throat entrance connectable to the source driver unit;

a rectangular throat exit connectable to or integral with the feeder section; and a circular cross-section to rectangular cross-section transition portion extending between the throat entrance and the throat exit, wherein the throat is shaped such that its profiles, through substantially all cross-sections longitudinal to the throat, initially diverge from an axis longitudinal to the throat at the same angle in a direction from the throat entrance towards the throat exit.

7. A directivity controlling acoustic horn assembly comprising:

a source driver unit having a divergent frusto-conical portion terminating in a circular exit for transmission of acoustic energy, the circular exit having a first diameter;

a throat having: a circular entrance having a second diameter substantially equal to the first diameter; a rectangular exit; and a circular cross-section to rectangular cross-section transition portion extending between the throat entrance and the throat exit, the circular entrance aligned with and abutting the circular exit of the source driver and the rectangular exit having a height and a width;

a feeder section having a first end and a second end, the first end connected to the exit of the throat; and a bell section having an entrance and terminating in an open mouth, the entrance of the bell section connected to or integral with the second end of the feeder section, wherein opposite profiles of the throat, lying within a first plane that bisects the throat entrance and perpendicularly bisects the long side of the throat exit, substantially match the angle of the frusto-conical portion at the exit of the source driver unit thereby providing a smooth transition for sound waves propagating from the source driver unit into the throat.

8. A horn as claimed in claim 7 wherein the height of the rectangular throat exit is less than the diameter of the throat entrance.

9. A horn as claimed in claim 8 wherein said profiles of the throat converge to a neck having a height less that the diameter of the entrance to the throat, thereby improving the dispersion of high frequency acoustic energy.

10. A horn as claimed in claim 9 wherein the throat is shaped such that its profiles, through substantially all cross-sections longitudinal to the throat, substantially match the angle of the frusto-conical portion at the exit the source driver unit thereby providing a smooth transition for sound waves propagating from the source driver unit into the throat.

* * * * *